United States Patent [19]

Yorita et al.

[11] Patent Number: 4,987,393

[45] Date of Patent: Jan. 22, 1991

[54] DIELECTRIC FILTER OF SOLID MOLD TYPE WITH FREQUENCY ADJUSTMENT ELECTRODES

[75] Inventors: Tadahiro Yorita; Haruo Matsumoto, both of Kanazawa, Japan

[73] Assignee: Murata Manufacturing Co., Ltd., Japan

[21] Appl. No.: 246,762

[22] Filed: Sep. 20, 1988

[30] Foreign Application Priority Data

Sep. 21, 1987 [JP] Japan ..... 62-143973[U]

[51] Int. Cl.[5] ..... H01P 1/202

[52] U.S. Cl. ..... 333/202; 333/207; 333/223

[58] Field of Search ..... 333/202, 206, 207, 222, 333/223

[56] References Cited

U.S. PATENT DOCUMENTS 4,342,972 8/1982 Nishikawa et al. ..... 333/136 X
4,721,932 1/1988 West ..... 333/207
4,757,288 7/1988 West ..... 333/206

FOREIGN PATENT DOCUMENTS 15401 1/1986 Japan ..... 333/211
117401 5/1987 Japan ..... 333/206

*Primary Examiner*—Benny Lee
*Attorney, Agent, or Firm*—Ostrolenk, Faber, Gerb & Soffen

[57] ABSTRACT

A filter having an improved frequency adjustment construction which is capable of conforming the frequencies of the resonators with better accuracy through improvements in the accuracy of the sizes of the electrodes used for frequency adjustment, and through better stabilizng of the filter characteristics through forming a positive connection between each electrode for adjustment use and the corresponding inner conductive film. Electrodes for adjustment use are formed on a base plate, which is a separate unit from the dielectric block, so as to connect them with the respective resonators through coupling members, whereby the size accuracy of the electrodes for adjustment use is improved so as to considerably improve the frequency adjustment accuracy. Also, the connection between the electrodes for adjustment use and the inner conductive films of the respective resonators is positively stabilized to improve the stability of the filter characteristics.

10 Claims, 4 Drawing Sheets

DIELECTRIC FILTER OF SOLID MOLD TYPE WITH FREQUENCY ADJUSTMENT ELECTRODES

BACKGROUND OF THE INVENTION

The present invention generally relates to a dielectric filter of a solid mold type to be used at frequencies of, for example, several hundred MHz, and more particularly, to a filter which has a frequency adjustment structure thereon which is able to conform the resonance frequencies of the respective resonators with better accuracy.

Conventionally, it is known to use a dielectric filter of a solid mold type as a filter at frequencies of several hundred MHz. Such a dielectric filter has a plurality of through holes formed in parallel in the dielectric block, has inner conductive films formed on the inner peripheral faces of the through holes, and has outer conductive films formed respectively on the outer side faces of the block and associated with the through holes so as to constitute at least a pair of resonators.

It is important for the respective resonators of this solid mold type of dielectric filter to be conformed with better accuracy to each other, as regards their resonance frequencies, corresponding to the desired filter characteristics. However, if there are three or more stages the frequency of a middle resonator is likely to become higher as compared with the resonators on the input- and output-side ends.

Thus, a frequency-regulation construction has been proposed which causes the frequency of the respective resonators to be conformed to each other. For example, as shown in FIG. 7, according to one method of forming electrodes 33*a*, 33*b* for performing such an adjustment, inner conductive films 32 extend onto the end face 31*a* on the open side of the dielectric block 31, with the inner conductive films also being formed on the inner peripheral faces of the through holes 31*b*. In this method, the electrodes 33*a*, 33*b* are usable for this adjustment, since they are formed in such shape and size as will provide the desired resonance frequencies.

However, the above-described conventional frequency adjustment construction has the following problems.

(1) The desired sizes of the adjustment electrodes are hard to produce accurately, thus resulting in lower adjustment accuracy of the frequency, in that the face on the open side of the dielectric block, on which each adjustment electrode is formed, is generally rough on the surface, whereby the inner conductive film extending from the inner peripheral face of the through hole may rise upwardly from the top face as a result of such rough surface, when a convenient manufacturing method is used.

(2) As the adjustment electrode is adapted to be connected with the inner conductive film at the top edge portion of the through hole, the connection may become incomplete because of a break, crack, or the like, of the edge portion, with the result that an undesirable frequency dispersion and/or Q deterioration are likely to be caused.

SUMMARY OF THE INVENTION

Accordingly, an essential object of the present invention is to provide a filter having an improved frequency adjustment construction which is capable of conforming each resonator frequency with better accuracy to a desired value. Improvements should be made in the accuracy with which the sizes of the frequency adjustment electrodes are set, and in the stabilizing of the filter characteristics through forming a positive connection between the electrode for adjustment use and the inner conductive film.

Another important object of the present invention is to provide a filter having an improved frequency adjustment construction, comprising a dielectric filter of a solid mold type which has a plurality of resonators formed on the dielectric block, and which also has electrodes for frequency adjustment use formed on a base plate, with the respective electrodes for adjustment use being connected with the inner conductive films of the respective resonators through coupling members extending between the base plate and the dielectric block.

According to the frequency adjustment construction of the present invention, a base plate for adjustment use which is a separate member from the dielectric block is provided, and electrodes for regulating the frequency are formed on the base plate so that there is no undesirable effect due to the surface roughness of the dielectric block, the upwardly rising inner conductive films, and so on. Furthermore, techniques such as photographic printing processes or the like which are capable of easily improving the size accuracy in the electrode formation may be adopted, so that the size accuracy of the electrode for adjustment use may be considerably improved. As a result, the frequencies of the respective resonators may be conformed with better accuracy. Also, the dispersion of the frequencies may be considerably reduced, so that the productivity may be correspondingly improved.

Also, as the electrode for adjustment use on the base plate and the inner conductive film of the dielectric block are adapted to be connected with each other through the coupling member, inferior connections can no longer be caused by cracks and so on of the through hole edge portion in the dielectric block, as can occur in the conventional construction, so again; the characteristics remain stable, so that the productivity is improved.

BRIEF DESCRIPTION OF THE DRAWINGS

These and other objects and features of the present invention will become clear from the following description of preferred embodiments thereof, with reference to the accompanying drawings, in which:

FIG. 1 and FIG. 2 are views for illustrating the frequency adjustment construction of a dielectric filter of a solid mold type according to one embodiment of the present invention, wherein FIG. 1 is an exploded perspective view thereof and FIG. 2 is a sectional view of the essential portion showing the connecting portion thereof;

FIG. 4 is a sectional view taken along a line IV—IV of FIG. 3(*a*);

DETAILED DESCRIPTION OF THE INVENTION

Figure 1:
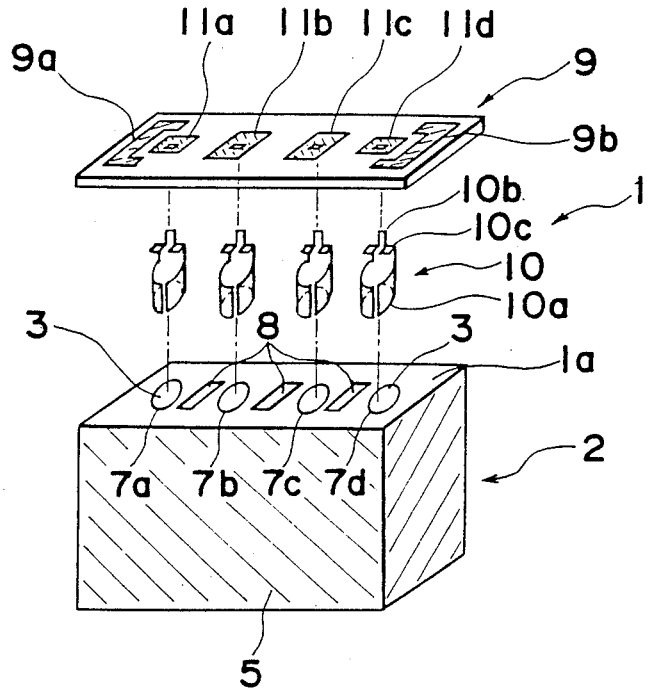

Before the description of the present invention proceeds, it is to be noted that like parts are designated by like reference numerals throughout the accompanying drawings.

Figure 2:
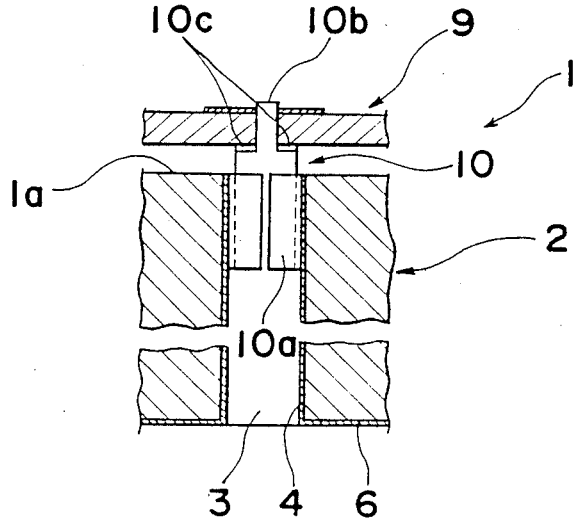

Referring now to the drawings, there is shown in FIG. 1 and FIG. 2 a frequency regulating construction according to one embodiment of the present invention, which includes a solid mold type dielectric filter 1 composed of a dielectric block 2, a base plate 9 for adjustment use, and a coupling terminal 10 for electrically and mechanically coupling the base plate 9 to the dielectric block 2.

The dielectric block 2 is made of, for example, titanium-oxide group dielectric sintered and molded into the shape of a solid rectangular parallelepiped, with four circular through holes 3 being formed in parallel at constant intervals. An inner conductive film 4 made of Ag baked and fixed in the form of a thin film is formed on the inner peripheral face of each through hole 3. Also, an outer conductive film 5 and a short-circuit conductive film 6 (FIG. 2) made of Ag baked on the dielectric block 2 are respectively formed on the four-side faces and the bottom face of the dielectric block 2. The films 4, 5 and 6 together form four dielectric resonators. It is to be noted that the short-circuit conductive film 6 short-circuits the inner and outer conductive films 4 and 5 to cause the four resonators to have a resonance mode of $\lambda/4$ wavelength, so that four-stage filter comprising four 1/4-wave resonators 7*a* through 7*d* is constructed.

Also, a cavity 8 for coupling use is formed through the dielectric block 3 between each pair of adjacent resonators 7*a* and 7*b*, 7*b* and 7*c*, and 7*c* and 7*d* of the dielectric block 2. The cavity 8 is of rectangular shape in cross-section and has an exposed ceramic texture, with the conductive film not being formed on the inner face, so that the coupling degree of the respective resonators 7*a* through 7*d* depends upon the shape and size of the cavity 8.

The coupling terminal 10 is a metallic plate wound into cylindrical shape, with a small gap formed with some elasticity in the lower (as shown in the drawings) cylindrical portion 10*a*, and has a connecting projection upward 10*b* projected from the lower cylindrical portion. On both sides of the projection 10*b* are support-member portions 10*c* bent transversely. The cylindrical portion 10*a* of the coupling terminal 10 is inserted into the open end 1*a* of the through hole 3 of the dielectric block 2, with the inserting portion adhering to the inner face of the inner conductive film 4 by expanding due to its elasticity.

The base plate 9 for adjustment use is placed on the top faces and supported by the support-member portions 10*c* of the coupling terminals 10. The base plate 9 for adjustment use is a dielectric base plate made of, for example, alumina ceramic group. Rectangular electrodes 11*a* through 11*d* for frequency adjustment use are formed respectively in the positions above the respective resonators 7*a* through 7*d*, on the top face of the insulating base plate. The respective electrodes 11*a* through 11*d* are baked and secured, for example, after Ag has been printed by a photographic printing process. The shape and size are provided so that the same resonance frequency is obtained all the respective resonators 7*a* through 7*d*. The connecting projection 10*b* of each coupling terminal 10 is projected from approximately the central portion of the respective electrodes 11*a* through 11*d* for frequency adjustment use, with the projecting portions being connected by, for example, soldering with the electrodes 11*a* through 11*d* for adjustment use. It is to be noted that reference numerals 9*a* and 9*b* are input and output electrodes for external connection use.

The functions and advantages effects of the present embodiment will be described hereinafter.

In the frequency adjustment construction of the present embodiment (FIGS. 1 and FIGS. 2), the shapes and sizes of the electrodes 11*a* through 11*d* can be readily controlled since they are formed on the top face of the base plate 9 for adjustment use, so that the resonance frequency of the respective resonators 7*a* through 7*d* may be conformed.

In this case, the size accuracy may be considerably improved, as compared with a prior art product in which the electrode for adjustment use is directly formed on the end face of the open side of the conventional dielectric block. This is because, in the prior art devices, the end face on the open side of the dielectric body is generally rough on its surface. This makes it uneconomical because of the difficulty of handling the dielectric body, and the increase in the number of manufacturing steps, and so on, if an attempt is made to smooth out the surface roughness of the open end face with a grinding operation or the like. Also, the inner conductive film formed on the inner peripheral face of the through hole is likely to rise upward, so it is hard to improve the size accuracy when the electrode for adjustment use is formed directly on the dielectric block 2.

In contrast, as the construction of the present embodiment has its electrodes 11*a* through 11*d* for adjustment use formed on the adjustment base-plate 9 which is a separate member from the dielectric block 2, it is easier to smooth out the surface roughness of the base plate 9 and it is possible to adopt various steps such as photographic printing process to easily improve the size accuracy in the formation of the electrodes 11*a* through lid, so that the disadvantageous influences caused by the rising of the above-described inner conductive film in prior art devices are removed. As a result, the size accuracy of the electrodes 11*a* through 11*d* for adjustment use may be considerably improved, the resonance frequency of the respective resonators 7*a* through 7*d* may be conformed with better accuracy, and productivity may be improved by thus limiting the number of inferior products.

Also, in the above-described prior art construction, the connection between the inner conductive film and the adjustment electrode plated directly on the open end face of the dielectric block can become unstable because of cracks and so on that may occur in the top-end corner portion of the through hole of the dielectric block, thus causing the dispersion and variation in the frequency of the relevant resonator. In contrast, in the present embodiment, the inner conductive film 4 is connected with the electrodes 11*a* through 11*d* for adjustment use through the coupling terminal 10, so negative influences are not caused by cracks and so on of the dielectric block 2. The connection is reliable and stable, the result is that the problem of frequency dispersion is not caused.

Furthermore, in the present embodiment, as the electrodes for adjustment use are formed in a predetermined pattern on the base plate 9 for adjustment, any frequency dispersion that is caused by the shapes of the respective resonators *7a* through *7d* and the coupling terminal 10 may be absorbed by the pattern of the electrodes 11*a* through 11*d* for adjustment.

In the embodiment of FIGS. 1 and 2, the base plate 9 for adjustment use is supported and positioned by the formation of the support projection 10*c* on the coupling terminal 10. A modified embodiment using a different support method for supporting the base plate 9 for adjustment use will now be disclosed.

Figure 3A:
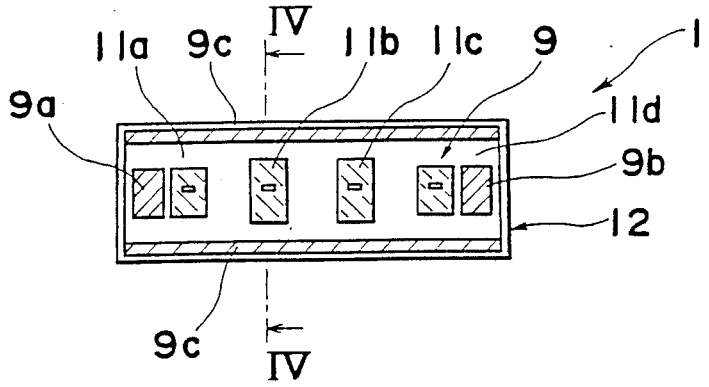
FIG. 3 and FIG. 4 show modifications of the embodiment of FIGS. 1 and 2, wherein FIGS. 3(*a*) and 3(*b*) are a plan view and side view thereof, respectively.
Figure 3B:
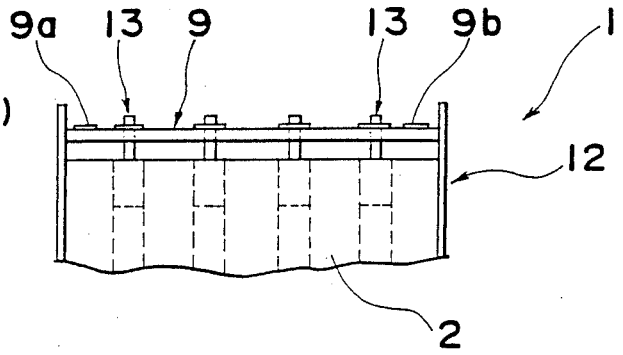
Figure 4:
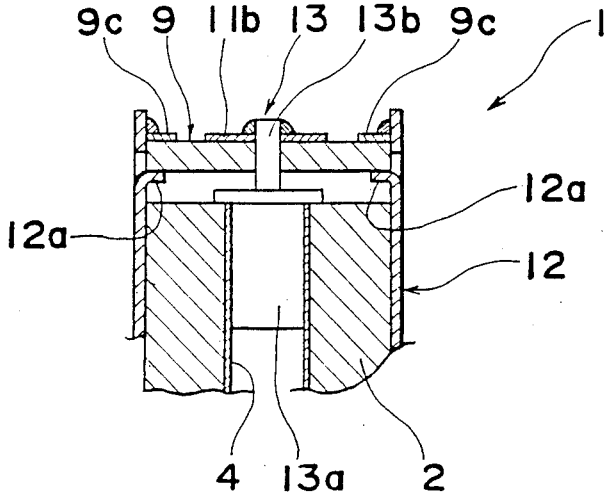

FIG. 3 and FIG. 4 show an embodiment, wherein the sides of a case 12 are inwardly cut, form a plurality of upward-facing support members 12*a* (FIG. 4) for supporting the base plate 9. The case 12 accommodates the dielectric filter 1 of a solid mold type In this embodiment, the coupling terminal 13 which has an inserting portion 13*a* (FIG. 4) and a connecting portion 13*b* (FIG. 4) is metallic and has a rod-shape, with the earth portion 9*c* formed on both the edge portions of the base plate 9 for adjustment use being soldered near the top end of the case 12.

Also, in the above-described embodiment, the adjustment electrode was formed only on the single face of the base plate for frequency adjustment use, but the electrode may be formed on both the faces. Also, although the explanation was given about the case of the filter having the cavity for coupling use, the present invention may be, of course, applied even to the filter having a conventional means for coupling between resonators different and free from the cavity for coupling use.

Figure 5A:
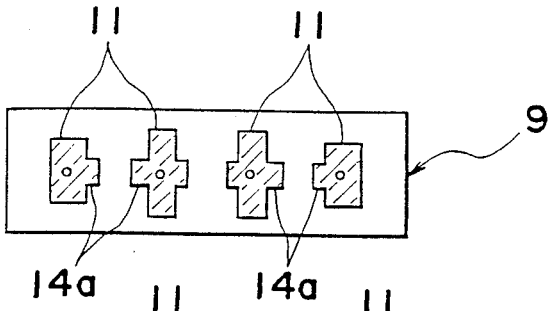
FIGS. 5(*a*) through 5(*c*) and FIGS. 6(*a*) and 6(*b*) are plan views, each showing arrangements wherein electrodes for performing other functions have been formed on the base plates.
Figure 5B:
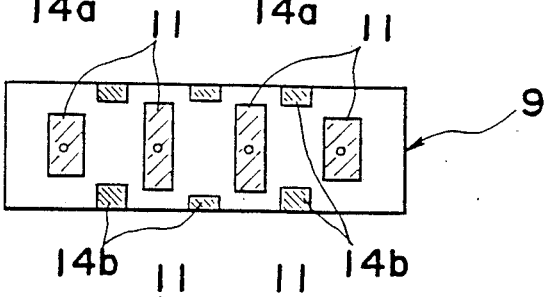
Figure 5C:
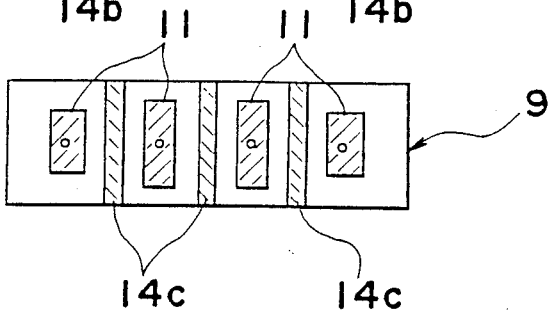
Figure 6A:
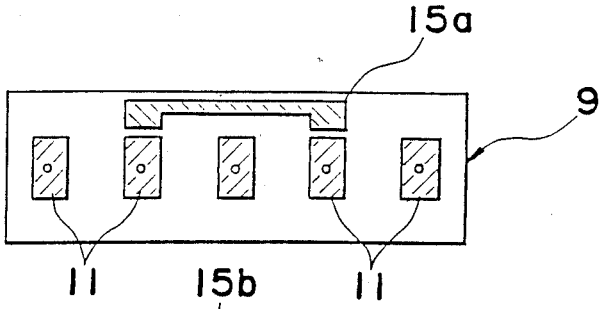
Figure 6B:
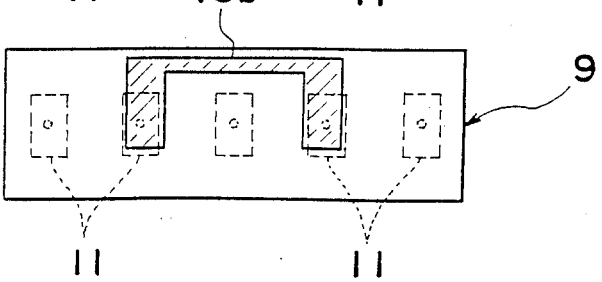
Figure 7:
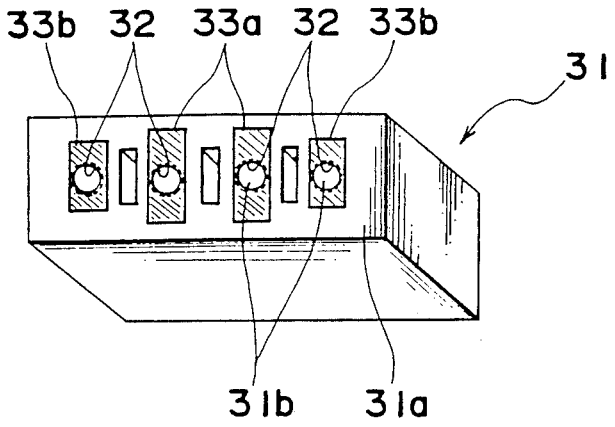
Fig. 7 PRIOR ART
FIG. 7 is a perspective view showing the conventional frequency adjustment construction.

Furthermore, although only the electrode for frequency adjustment was formed on the base plate for adjustment in the above embodiment, an electrode film which achieves other functions may be added on the basic plate as shown in FIG. 5 and FIG. 6.

FIGS. 5(*a*) through 5(*c*) show an embodiment, wherein the electrode 11 for adjustment use is formed, furthermore, the adjustment electrodes 14*a* (FIG. 5*a*), 14*b* (FIG. 5*b*), and 14*c* (FIG. 5*c*) for regulating the coupling degree of each resonator are formed. The electrodes 14*b* and 14*c* are grounded. It is to be noted that the electrodes 14*a* through 14*c* for regulating the coupling degree of FIGS. 5(*a*) through 5(*c*) may be properly combined.

Also, FIGS. 6(*a*) and 6(*b*) show an embodiment, wherein electrodes 15*a* and 15*b* for polarized use are formed to couple the respective resonators every other one to steepen an attenuation characteristic by forming frequency response poles. Needless to say, it is possible to combine the electrode of FIG. 6 with that of FIG. 5.

As is clear from the foregoing description, according to the frequency adjustment construction of the present invention, electrodes for adjustment use are formed on the base plate for adjustment use, which is a separate unit from the dielectric block, and they are connected with the respective resonators through the coupling members. The result is that the size accuracy of the electrodes for adjustment is improved to considerably improve the adjustment accuracy of the frequency of each resonator. Also, the connection between the electrodes for adjustment use and the inner conductive films of the respective resonators is positively stabilized to improve the stability of the characteristics.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A dielectric filter of a solid mold type having a plurality of adjacent resonators and a construction for regulating respective resonant frequencies of the plurality of resonators, comprising a dielectric block provided with a plurality of through holes which are formed parallel to each other in the dielectric block, inner conductive films formed on inner peripheral surfaces of the through holes, outer conductive films formed on portions of outside surfaces of the dielectric block and associated with said through holes so as to constitute the plurality of resonators, a base plate, electrode means for frequency adjustment formed on the base plate, including a plurality of respective adjustment electrodes which are electrically connected, via coupling members, to the inner conductive films of the respective resonators at first ends of said resonators, said first ends being at a first face of said dielectric block having no conductive film, whereby the resonant frequencies of said resonators are adjustable to equalize them by adjusting a dimension of each respective adjustment electrode of each resonator and thereby adjusting a capacitance between said respective adjustment electrodes and said outer conductive films, means on said coupling members for supporting said base plate adjacent to said first face of said dielectric block, and respective coupling cavities formed through said dielectric block between adjacent pairs of resonators of the dielectric block, said coupling cavities having exposed ceramic surfaces therein with no conductive film being formed on said exposed ceramic surfaces of said cavities, said resonators being coupled to each other substantially only by said coupling cavities.

2. The filter as defined in claim 1, wherein the dielectric block is made of titanium-oxide dielectric sintered and molded to form a rectangular solid, with four circular through holes being formed parallel to each other and at constant intervals.

3. The filter as defined in claim 1, wherein the inner conductive films are formed from Ag and baked and fixed to form thin films.

4. The filter as defined in claim 1, wherein said outside surfaces of said dielectric block include a plurality of side faces adjacent to said first face which are plated with an outer conductive film, and a short-circuit conductive film is formed on a bottom face opposite said first face, interconnecting said outer conductive film and said inner conductive films, said films being formed from Ag baked on the side faces and the bottom face of the dielectric block, the short-circuit conductive film being disposed so as to short-circuit the inner and outer conductive films to cause the resonators to be $\lambda/4$ wavelength resonators.

5. The filter as defined in claim 1, wherein said coupling cavities each have a, rectangular cross-sectional shape.

6. The filter as defined in claim 1, wherein each coupling member is a metallic plate wound into a generally cylindrical shape, a relatively thick cylindrical portion being formed with a circumference-adjusting gap therein, and sized to fit into said resonators at said first ends thereof, and to exert an outward-directed elastic force against said resonators, and a connecting member being projected vertically toward said base plate from the cylindrical portion, the connecting member having a second end which is away from said cylindrical portion and which is divided into a connecting projection and a bent support-member portion.

7. The filter as defined in claim 6, wherein the base plate is placed on a top face of the bent support-member portion of each coupling member and is an insulating base plate made of an alumina series ceramic material.

8. The filter as defined in claim 1, wherein the electrode means comprise rectangular adjustment electrodes formed respectively in the positions above the respective resonators on a top face of the insulating base plate.

9. The filter as defined in claim 8, wherein a connecting projection of each coupling member is projected approximately toward a central portion of the respective adjustment electrode for frequency regulation use, with the connecting projections being conductively connected with said adjustment electrodes.

10. A dielectric filter comprising:

a dielectric block made of dielectric material having a top surface, a bottom surface and four side surfaces, said bottom surface and side surfaces being substantially covered by conductive material, said block being provided with a plurality of through holes each extending from the bottom surface of the top surface, inner surfaces within the holes being substantially covered by conductive material, and the openings of the holes being disposed with a predetermined distance between one another on the top surface, each said through hole forming a respective resonator of said filter, and each said resonator having a respective resonant frequency;

first coupling means connected with a first opening selected from among the through hole openings;

a dielectric base plate positioned by spacer means on the top surface of the dielectric block, said base plate being spaced a predetermined distance from the top surface of the dielectric block;

at least a first electrode provided on the dielectric base plate and electrically connected by said first coupling means with the conductive material on the inner surface of said first opening;

at least a second electrode provided on the dielectric base plate, the second electrode being spaced a predetermined distance from the first electrode and electrically connected by a coupling member with the conductive material on the side surface of the dielectric block, whereby the resonant frequency of the resonator of said first hole is adjustable by adjusting a dimension of said first electrode, and thereby adjusting a capacitance between said first electrode and said second electrode; and respective coupling cavities formed through said dielectric block between adjacent pairs of resonators of the dielectric block, said coupling cavities having exposed ceramic surfaces therein, with no conductive film being formed on said exposed ceramic surfaces of said cavities, said resonators being coupled to each other substantially only by said coupling cavities.

* * * * *